US010434368B2

(12) United States Patent
Chazalon et al.

(10) Patent No.: US 10,434,368 B2
(45) Date of Patent: Oct. 8, 2019

(54) CONTROL OF AN EXERCISE MACHINE

(71) Applicant: ERACLES-TECHNOLOGY, Compiegne (FR)

(72) Inventors: Philippe Chazalon, Arsy (FR); Arnaud Vannicatte, Saint-Aubert (FR); Aurelien Vauquelin, Compiegne (FR)

(73) Assignee: Eracles-Technology, Compiegne (FR)

( * ) Notice: Subject to any disclaimer, the term of this patent is extended or adjusted under 35 U.S.C. 154(b) by 274 days.

(21) Appl. No.: 14/787,991

(22) PCT Filed: Apr. 11, 2014

(86) PCT No.: PCT/FR2014/050896
§ 371 (c)(1),
(2) Date: Oct. 29, 2015

(87) PCT Pub. No.: WO2014/177787
PCT Pub. Date: Nov. 6, 2014

(65) Prior Publication Data

US 2016/0151675 A1 Jun. 2, 2016

(30) Foreign Application Priority Data

Apr. 29, 2013 (FR) ..... 13 53911

(51) Int. Cl.
*A63B 24/00* (2006.01)
*A63B 21/005* (2006.01)
(Continued)

(52) U.S. Cl.
CPC ..... *A63B 24/0087* (2013.01); *A63B 21/005* (2013.01); *A63B 21/0053* (2013.01);
(Continued)

(58) Field of Classification Search
CPC ..... A63B 24/0087; A63B 21/005; A63B 21/0053; A63B 21/00181; A63B 21/0058;
(Continued)

(56) References Cited

U.S. PATENT DOCUMENTS 4,930,770 A * 6/1990 Baker ..... A63B 21/00178 482/132
5,117,170 A * 5/1992 Keane ..... A63B 21/0058 318/400.2
(Continued)

FOREIGN PATENT DOCUMENTS

EP 2255851 A1 12/2010
WO 2007/043970 A1 4/2007
(Continued)

OTHER PUBLICATIONS

International Search Report of PCT/FR2014/050896 dated Jul. 17, 2014.

*Primary Examiner* — Sundhara M Ganesan
(74) *Attorney, Agent, or Firm* — Muncy, Geissler, Olds & Lowe, P.C.

(57) ABSTRACT

A method for controlling an electric actuator in an exercise device, comprising:

supplying a first load set point ($F_A$, $k_A$) upon a displacement of the load element in a first direction, supplying a second load set point ($F_B$, $k_B$) upon a displacement of the load element in a second direction, and detecting an initial position (M) of the moving part of the electric actuator when the reversal of the movement is detected, computing an end-of-transition position (N) exhibiting a deviation in the second direction relative to the initial position, (Continued)

supplying a transition load set point in the form of a monotonic function of the position of the moving part of the electric actuator or of the load element, said monotonic function varying from the first load set point ($F_A$, $k_A$) to the second load set point ($F_B$, $k_B$) between the initial position (M) and the end-of-transition position (N).

13 Claims, 6 Drawing Sheets

(51) Int. Cl.
*A63B 21/00* (2006.01)
*A63B 71/00* (2006.01)
*A63B 21/002* (2006.01)

(52) U.S. Cl.
CPC .... *A63B 21/0058* (2013.01); *A63B 21/00181* (2013.01); *A63B 21/002* (2013.01); *A63B 2071/0072* (2013.01); *A63B 2220/13* (2013.01); *A63B 2220/22* (2013.01); *A63B 2220/40* (2013.01); *A63B 2220/801* (2013.01)

(58) Field of Classification Search
CPC ..... A63B 21/002; A63B 2071/0072; A63B 2220/801; A63B 2220/13; A63B 2220/22; A63B 2220/40
See application file for complete search history.

(56) References Cited

U.S. PATENT DOCUMENTS

| | | | | |
|---|---|---|---|---|
| 6,280,361 | B1 * | 8/2001 | Harvey | A63B 21/025 482/101 |
| 8,475,338 | B2 * | 7/2013 | Greenhill | A63B 21/0058 482/1 |
| 2008/0248926 | A1 * | 10/2008 | Cole | A63B 24/00 482/5 |
| 2010/0069202 | A1 * | 3/2010 | Olsen | A63B 21/0058 482/5 |
| 2012/0109025 | A1 * | 5/2012 | Weinberg | A63B 23/14 601/5 |

FOREIGN PATENT DOCUMENTS

| | | | |
|---|---|---|---|
| WO | 2011/083434 | A1 | 7/2011 |
| WO | 2012/176165 | A2 | 12/2012 |

* cited by examiner

CONTROL OF AN EXERCISE MACHINE

The invention relates to the field of exercise machines. More particularly, the invention relates to the field of machines with electric motor drive designed to develop or reconstitute the musculature of a user and being used in particular for sport training or for the reeducation of the muscles of a user.

Among the muscle exercise machines, there are in particular weight machines and inertia machines.

The weight machines operate on the principle of weights made of cast iron or another material that a user moves by imparting a force to counter the weight of the cast iron masses. These machines are notably presses, free weights, guided load appliances, etc.

The inertia machines operate differently. These consist, for example, in setting a disc of cast iron in motion about a rotation axis. The user must therefore impart an adequate force to overcome the inertia of the machine. Some machines operate with the principle of setting a fluid in motion with a system of fins. Although the fluid set in motion has an inertia, in these machines the user must primarily overcome the viscous friction induced by the fluids. Other machines use the principle of the eddy current system to generate these viscous frictions. These machines that produce viscous frictions are notably the machines of rowing machine or exercise bicycle type. Dry friction machines also exist. In this way, certain exercise bicycles arrange a revolving belt on an inertial wheel with dry friction.

EP-A1-2255851 describes a muscle training apparatus suitable for applying a load to a user by means of the motive torque of an electric actuator. It comprises speed detection means and a characteristic load curve applied as a function of the speed. In an embodiment represented in FIG. 7, two different isotonic loads are applied, on the one hand in a concentric direction of movement at a speed above a first speed threshold and on the other hand in an eccentric direction of movement at a speed above a second speed threshold. The transition between the two isotonic loads is performed according to an affine function of the speed of the displacement. Because of the increase in the load applied proportionally to the detected speed, the movement of the user does not necessarily cross the set speed thresholds, such that the programmed isotonic load is not necessarily applied during the movement.

According to one embodiment, the invention provides a control method for controlling an electric actuator in an exercise device comprising a load element intended to be displaced by the force of a user and coupled to a moving part of the electric actuator, the control method comprising:

supplying a first load set point upon a displacement of the load element in a first direction, supplying a second load set point upon a displacement of the load element in a second direction opposite to the first direction, and in response to the detection of a reversal of the displacement of the load element between the first direction and the second direction, supplying a transition load set point varying progressively from the first load set point to the second load set point during a time interval.

According to one embodiment, the method further comprises:

detecting an initial position of the moving part of the electric actuator or of the load element at the moment when the reversal of the movement is detected, computing an end-of-transition position exhibiting a deviation in the second direction relative to the initial position, supplying the transition load set point in the form of a monotonic function of the position of the moving part of the electric actuator or of the load element, said monotonic function varying from the first load set point to the second load set point between the initial position and the end-of-transition position.

According to one embodiment, the transition load set point varies with a rate of variation per unit of displacement that is constant from the first load set point to the second load set point, the monotonic function being an affine function. According to alternative embodiments, the monotonic function can have other forms, for example a polynomial function, an exponential function, a trigonometric function or similar.

According to one embodiment, the deviation between the end-of-transition position and the initial position is a predetermined constant.

According to one embodiment, the deviation between the end-of-transition position of the load element and the initial position of the load element lies between 2 and 200 mm, preferably between 20 and 100 mm.

In the embodiments, the deviation between the end-of-transition position and the initial position is computed as a function of one or more parameters, for example as a function of an average speed of the load element measured during the movement or as a function of the difference between the first load set point and the second load set point. According to one embodiment, the deviation between the end-of-transition position and the initial position is an increasing function of the average speed of the load element. Thus, even in a very fast exercise, the time interval over which the transition load set point is developed does not risk being shortened to the point of creating a discomfort for the user, for example a sensation of impact.

According to one embodiment, the method further comprises:

detecting an instantaneous speed of the load element or of the moving part of the electric actuator, and detecting the reversal of the displacement of the load element between the first direction and the second direction in response to a change of sign of the detected speed.

According to one embodiment, the method further comprises:

detecting the instantaneous position of the load element or of the moving part of the electric actuator over time, detecting an extreme position of the load element or of the moving part of the electric actuator in the first direction, determining a deviation in the second direction between the detected instantaneous position and the extreme position, and detecting the reversal of the displacement of the load element between the first direction and the second direction when the deviation in the second direction crosses a determined reversal threshold.

According to one embodiment, the reversal threshold is a predetermined constant. The value of the reversal threshold is preferably chosen to satisfy two competing objectives, namely to allow for reliable detection without false detection or artifacts and to allow a response time that is rapid and imperceptible or barely perceptible to the user.

According to one embodiment, the reversal threshold lies between 2 and 200 mm, preferably between 5 and 20 mm.

In the embodiments, the reversal threshold is computed as a function of one or more parameters, for example as a function of an average speed of the load element measured during the movement. According to an embodiment, the reversal threshold is a decreasing function of the average speed of the load element. Thus, the reversal detection can be made in a highly responsive manner and without delay that is perceptible by the user even in a very fast exercise.

According to one embodiment, the method further comprises: in response to the detection of a second reversal of the displacement of the load element between the second direction and the first direction, supplying a second transition load set point varying progressively from the second load set point to the first load set point during a second time interval.

According to one embodiment, the method further comprises:

detecting a second initial position of the moving part of the electric actuator or of the load element at the moment when the second reversal of the movement is detected, computing a second end-of-transition position exhibiting a deviation in the first direction relative to the second initial position, supplying the second transition load set point in the form of a monotonic function of the position of the moving part of the electric actuator or of the load element, said monotonic function varying from the second load set point to the first load set point between the second initial position and the second end-of-transition position. This second transition load set point can be computed in the same way as or differently from the first transition load set point, depending on whether the aim is for a symmetrical or asymmetrical behavior of the electric actuator upon the two reversals of direction.

According to one embodiment, the method further comprises:

computing a force to be exerted by the electric actuator at successive instants during displacements of the load element as a function of the load set point supplied at each of said successive instants, and generating a control signal to control the electric actuator with the control signal such that the force exerted by the electric actuator in response to the control signal corresponds to the computed force to be exerted.

According to one embodiment, the force to be exerted is computed as a sum of the load set point supplied at each of said successive instants with at least one additive contribution selected from a contribution of inertial force proportional to a measured instantaneous acceleration of the moving part of the electric actuator or of the load element, a contribution of elastic force proportional to the deviation between a reference position and a measured instantaneous position of the moving part of the electric actuator or of the load element, and a contribution of viscous force proportional to a measured instantaneous speed of the moving part of the electric actuator or of the load element.

According to one embodiment, the invention also provides an exercise device comprising:

a load element intended to be displaced by the force of a user, an electric actuator comprising a moving part, the load element being coupled to the moving part, a computer configured to compute a force to be exerted by the electric actuator at successive instants during displacement of the load element as a function of a load set point supplied at each of said successive instants and to generate a control signal of the electric actuator as a function of the computed force to be exerted, in which the computer is configured to:

supply a first load set point upon a displacement of the load element in a first direction, supply a second load set point upon a displacement of the load element in a second direction opposite to the first direction, and in response to the detection of a reversal of the displacement of the load element between the first direction and the second direction, supply a transition load set point varying progressively from the first load set point to the second load set point during a time interval.

According to one embodiment, the load element comprises a handle intended to be held in the hand by the user to exert the force of the user, the handle bearing a control member that can be actuated by the user to control a function of the computer.

By virtue of these features, the handle serves both as grip to exert the muscular force of the user and as remote control for certain functions of the exercise device, for example setting the load or the inertia or selecting the work program. According to one embodiment, the handle has a "dead-man" button or lever producing a positive safety function, for example by causing the electrical power supply of the actuator to be cut should the button or lever be released. According to one embodiment, the control member on the handle controls a function for changing load upon the reversal of the movement, which means that the transition between the two load set points is triggered only if the button or lever is in an actuated state at the moment when the reversal of the movement is detected. Otherwise, the load set point remains unchanged upon the reversal of the movement.

According to one embodiment, the link between the load element and the moving part includes a speed reducer for gearing down the force of the motor. Generally, such a reducer generates an additional real inertia for the user who actuates the load element. According to one embodiment, the contribution of artificial inertia exerted by the electric actuator may compensate all or part of the additional real inertia generated by the reducer.

According to one embodiment, the electric actuator is a linear motor. According to one embodiment, the electric actuator is a rotary motor in which the moving part comprises a rotor of the rotary motor.

According to one embodiment, the acceleration sensor comprises:

a position coder coupled to the moving part for measuring the position of the moving part, the position coder generating a position signal, shunt elements suitable for shunting the position signal to determine the acceleration of the moving part.

According to one embodiment, the exercise device is selected from the group comprising rowing machines, exercise bicycles, lifting bars and guided load appliances.

According to one embodiment, the load element can be displaced in a vertical direction and the computer is able to compute the force to be exerted in the absence of force exerted by the user, in such a way that the force to be exerted by the electric actuator includes a default contribution of load compensating a specific weight of the load element without causing any spontaneous displacement of the load element in the absence of force exerted by the user.

One idea upon which the invention is based is to produce an asymmetrical load of the user in an eccentric movement and a concentric movement while preserving comfort in using the exercise machine, notably by avoiding impacts upon the reversal of the movement. Some aspects of the invention start from the idea of simulating, on an exercise machine, when the machine is being used by a user, an inertia that is different from the real inertia of the exercise machine, using an electric actuator.

Some aspects of the invention start from the idea of devising a machine which makes it possible to vary the weight and the inertia independently of one another.

Some aspects of the invention start from the idea of simulating, on the exercise machine, an additional weight using the electric actuator.

Some aspects of the invention start from the idea of simulating, on the exercise machine, an additional friction using the electric actuator.

Some aspects of the invention start from the observation that combining the exercises of "inertia" type characteristic of the inertia machines and the exercises of "weight" type characteristic of the weight machines in a single machine allows for a significant space saving and a less costly investment.

Some aspects of the invention start from the idea of generating additional inertia forces in certain phases of a muscle exercise performed by the user and of cancelling these inertia forces in the other phases of the muscle exercise.

Some aspects of the invention start from the idea of generating inertia forces without fixed load to create muscular stresses specific to the reversal of the movement of a mass launched on a substantially horizontal trajectory, notably the reversal of the movement of a runner.

The invention will be better understood, and other aims, details, features and advantages thereof will become more clearly apparent during the following description of a number of particular embodiments of the invention, given solely by way of illustration and in a nonlimiting manner, with reference to the attached drawings.

Figure 1:
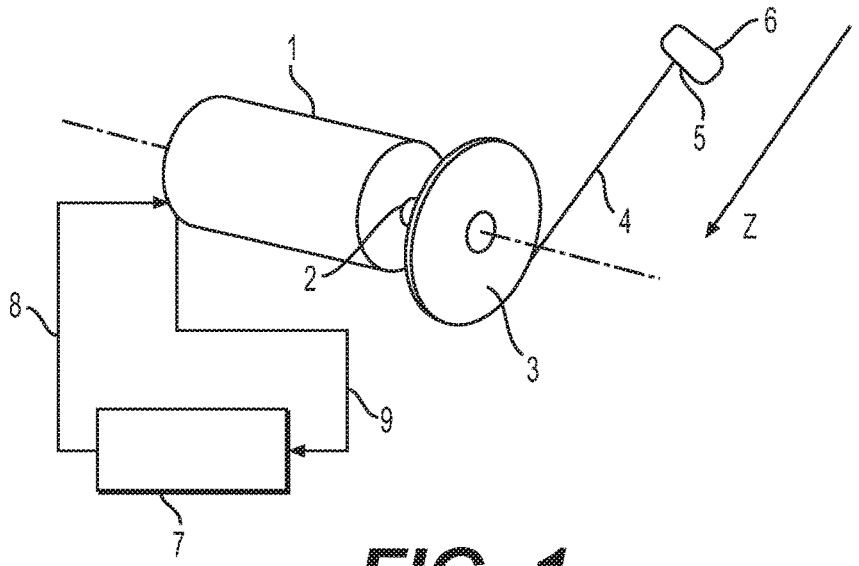
FIG. 1 is a schematic representation of an exercise device including a motor.
Figure 2:
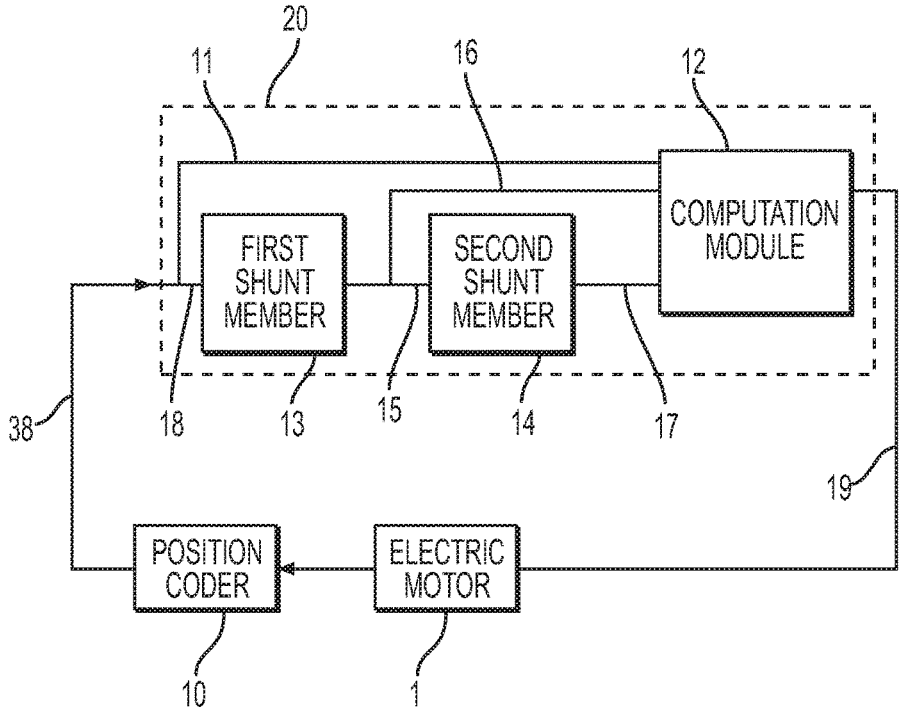
FIG. 2 is a schematic representation of the control system of the motor represented in FIG. 1.

FIGS. 1 and 2 illustrate an exercise device in which control methods according to the invention can be implemented. Referring to FIG. 1, the exercise device comprises an electric motor 1 which can rotationally drive a shaft 2 and exert a torque on the shaft 2. A pulley 3 is tightly mounted on the shaft 2. A cable 4 is fixed at its first end in the groove of the pulley 3. This cable 4 can be wound in the groove around the pulley 3. The second end 5 of the cable has a handle 6 fixed to it, via which a user can influence the device with his or her muscular force when practicing muscular exercises.

The motor 1 comprises a position coder 10 which measures the position of the motor shaft 2. The position is transmitted to an electronic board 7 in the form of a position signal 9. This electronic board 7 is designed to receive this position signal and uses the position signal 9 to generate a control signal. By virtue of this control signal, the electronic board 7 controls the torque generated by the motor 1 to control the force exerted by the motor 1, which is transmitted to the handle 6 via the pulley 3 and the cable 4. For this, the electronic board 7 transmits the control signal to the motor 1 via the connection 8. This control signal is received by a power supply member incorporated in the motor 1 which, from this control signal, supplies a certain current to the motor 1. The current supplied by the power supply member thus induces a torque on the moving part 2 and therefore, via the pulley 3 and the cable 4, a force on the handle 6. The force exerted by the motor 1 is substantially proportional to the current supplied by the power supply member to the motor 1.

Numerous control methods can be implemented in such a device in order to produce different muscular stresses. A first example is to simulate the presence of a predetermined mass suspended on a cable, namely that the motor torque exerts on the handle 6 a load that is constant in terms of direction and intensity.

When a user manipulates the handle 6 during an exercise, the user opposes the force of the motor 1 using his or her muscular force. For example, in an exercise that can be practiced with this device, a user is positioned above the device and performs a pulling action on the handle 6 from a low position to a high position using his or her hands. In this upward displacement, the user must overcome the force directed downward exerted by the motor 1 on the handle 6. When the handle 6 arrives in the high position, the user performs the reverse movement and returns the handle 6 to the low position while still being constrained by the same force which is subjected in the same direction by the motor 1. In the descent, the user accompanies and slows the downward displacement of the handle. The exercise device thus simulates a mass that has to be alternately raised and lowered by the user.

During this exercise, the position signal is transmitted continuously to the electronic board 7 which computes and continuously transmits the corresponding control signal to the motor. Thus, the device controls the force generated by the motor 1 throughout the exercise.

However, theoretically there may be a slight offset between the moment when the coder transmits the position and the torque exerted by the motor 1 because of the response time of the motor 1 to the control signal and the response time of the electronic board 7. With electronic components of good quality, this offset remains imperceptible and has no effect on the feelings of the user of the exercise device.

Referring to FIG. 2, the control means of the motor will now be described more specifically with reference to a second example.

The electronic board 7 here comprises a microprocessor 20. A position coder 10 measures the position of the shaft of the motor 2, this position is encoded into a position signal which is transmitted via the connection 38 to the microprocessor 20. Thus, in one embodiment, this measurement can be emitted every 30 ms and preferably every 5 ms. In this microprocessor 20, the position signal is transmitted to a shunt member 13 via the connection 18. The shunt member shunts the position signal thus generating a speed signal which is transmitted to a second shunt member 14 via the connection 15. The second shunt member shunts the speed signal thus generating an acceleration signal. The acceleration signal is transmitted via the connection 17 to a computation module 12. Moreover, the position signal and the speed signal are respectively transmitted to the computation module 12 via the connections 11 and 16. The computation module 12 computes the control signal to be supplied to the motor and transmits it to the motor via the connection 19.

More specifically, the control signal is computed from the acceleration such that the force exerted by the motor 1 on the handle 6 includes the load directed downward and a predetermined artificial inertia.

For this, the computation module 12 takes into account the aggregate of the torque exerted by the motor 1 and the inertia of the rotating parts of the device liked to this motor that are the shaft 2, the pulley 3, the cable 4 and the handle 6.

In effect, when a user manipulates the handle 6:

$$m_r \times \gamma = F_m + F_s \quad (1)$$

in which $F_s$ is the force exerted by the user on the handle 6, $F_m$ is the force exerted by the motor 1 on the handle 6 and controlled by the computation module 12, $m_r$ is the inertia of the moving parts brought to the handle 6 and the mass of the handle 6 and $\gamma$ is the acceleration of the handle 6.

The equation (1) corresponds to the fundamental principle of dynamics applied to a translational system. However, a person skilled in the art will understand that the torques exerted on a rotational system can be modeled in a similar manner The force exerted by the motor $F_m$ consists of two components induced by the control signal: a fixed component $F_{ch}$ representing the load and a component proportional to the acceleration $F_i$ which represents the artificial inertia. Thus:

$$F_m = F_{ch} F_i \quad (2)$$

in which the force $F_i$ is defined as a function of a coefficient of proportionality k:

$$F_i = k \times \gamma \quad (3)$$

The coefficient k is a parameter which is programmed in the computation module 12.

The equation (1) can be rewritten:

$$(m_r + k) \times \gamma = F_{ch} + F_s \quad (4)$$

In this way, if the coefficient of proportionality k used to produce the control signal is negative, namely $-m_r < k < 0$, the device simulates an inertia that is lower than the real inertia of the device, that is to say the inertia of the rotating parts of the device. If the coefficient of proportionality k is positive, the device simulates an inertia that is greater than the real inertia of the device.

The user, through a user interface that is not represented, can modify the values of the fixed component $F_{ch}$ and of the proportionality factor k and thus determine the type of effort with which he or she wants to exercise. Thus, it is possible to independently vary the load of the inertia. A wide range of muscular exercise types can therefore be offered to the user.

The user interface is connected to the computation module 12 and is able to receive data concerning the position, the speed, the acceleration, or information computed from these data, for example the effort supplied or the power dispensed. These data and information are computed by the computation module 12 from the acceleration, speed and position signals transmitted to the computation module 12 respectively via the connections 17, 16 and 11. With these data and this information, the user interface can sensorially stress the user by displaying this information. The user can in this way follow the level of his or her effort in his or her physical exercises. However, these stresses may be of different natures, sound stresses can for example be envisaged. Moreover, the user interface comprises control members enabling the user to vary the values of the fixed component $F_{ch}$ and of the proportionality factor k, preferably independently of one another. These control members are, for example, buttons on the user interface corresponding to predetermined pairs of fixed component $F_{ch}$ and proportionality factor k. Theses pairs thus define a number of exercise types. A storage member, for example a memory in the computation module 12, makes it possible to store this information and data. Through this storage, the user can follow the trend of his or her performance levels over time.

Figure 3:
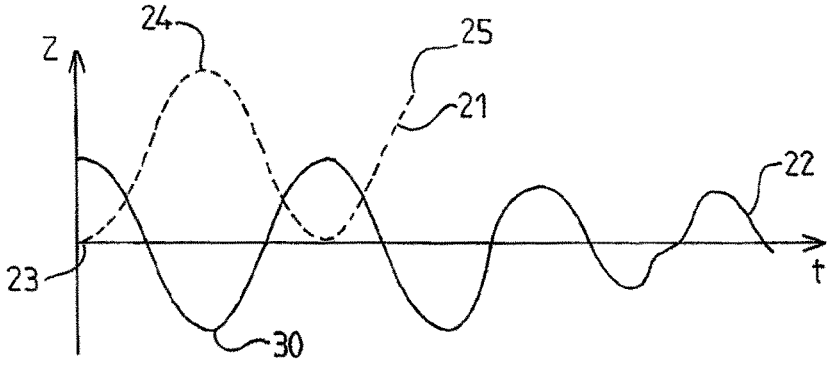
FIG. 3 is a graph of the position and acceleration as a function of time of the handle described in FIG. 1 corresponding to a manipulation by the user.
Figure 5:
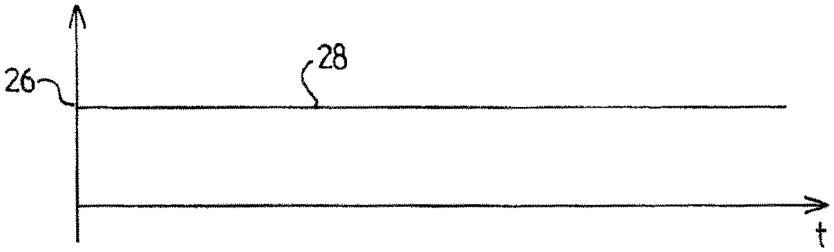
FIG. 5 is a graph of the force exerted by the motor upon the manipulation of the device in accordance with FIG. 3 corresponding to a first type of exercise.
Figure 6:
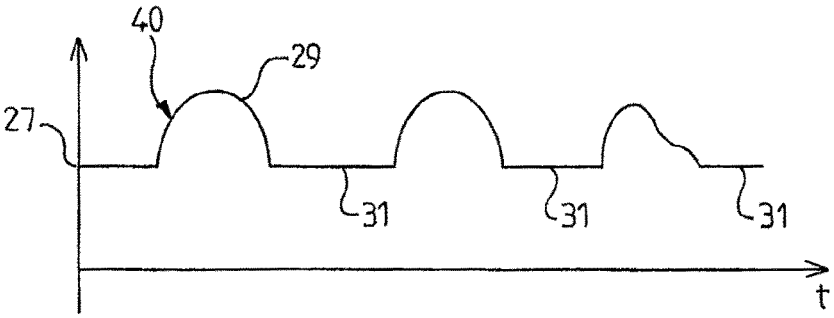
FIG. 6 is a graph of the force exerted by the motor upon the manipulation of the device in accordance with FIG. 3 corresponding to a second type of exercise.

Referring to FIGS. 3, 5 and 6, a number of particular examples of exercises which can be produced by the device described above will be described.

FIG. 3 represents the position of the handle 6 along the axis z of FIG. 1 and the acceleration of the handle 6 as a function of time in handle pulling stresses represented with reference to FIG. 1. The broken line curve 21 represents the position of the handle which is measured by the position coder 10. The continuous curve 22 represents the acceleration corresponding to the position curve 21. By convention, the axis z is oriented downward in FIG. 1. The point 24 of the position curve 21 therefore corresponds to the moment when the handle 6 is in the low position and the point 23 corresponds to the high position of the handle.

For the purposes of illustration between the point 23 and the point 25, the position curve 21 is substantially sinusoidal. Thus, the acceleration also forms, along this period, a sinusoidal curve. Consequently, the position curve is no longer sinusoidal and therefore the acceleration is no longer sinusoidal.

FIG. 5 represents the force exerted by the motor 1 against the user as a function of time for the same time interval as FIG. 3. The curve 28 is constant at the level of a threshold 26. In practice, FIG. 5 corresponds to a first exercise in which the computation module supplies a control signal to the motor in such a way that the force exerted against the user is constant in time. For this, the computation module produces a control signal inducing a force that has a load component equal to the threshold 26 and a zero inertia component. In this exercise, the user therefore works solely against a fixed load and the real inertia of the system.

FIG. 6 represents a second exercise which partially uses the principle of the first exercise described with reference to FIG. 5. The curve 40 represents the force generated by the motor 1 during this exercise. It comprises two phases: a high phase 31 during which the curve is constant at the level of the threshold 27 and a low phase during which the curve adopts the form of the acceleration curve at the level of the threshold 27. In practice, the user is subjected to a load force corresponding to the threshold 27 when the measured acceleration is positive, that is to say, here, during high phases 31 of the manipulation of the handle in which the handle is close to its high position 23. The user is, however, subjected to an additional inertia force oriented in the same direction as the load force when the measured acceleration is negative, that is to say during a low phase 29 when the handle arrives in the low position 24 and the user slows down the descent and then accelerates to perform a pulling action on the handle toward the high position 23. This low phase corresponds to the phase 30 during which the acceleration is negative. In this way, the user is subjected to an additional artificial inertia when he or she arrives at the low position and wants to raise the handle again toward the high position, that is to say at the moment when his or her muscular stress is most intense. Thus, the exercise device makes it possible to produce an additional stress which works against the user in a reversal of the direction of the movement of this user.

For the implementation of the second exercise, the computation module 12 applies a coefficient of proportionality k determined as follows:

$$\text{If } \gamma>0, k=0 \tag{5}$$

$$\text{If } <0, k=+k_0, \text{ i.e. } k>0 \tag{6}$$

in which $k_0$ is a predetermined positive constant.

The exercises described above are given by way of illustration. In particular, the computation module can control the coefficient of proportionality k in many ways. As an example, the computation module can vary the coefficient of proportionality as a function of the position or the speed of the handle. Thus, in a variant, the exercise device produces a component of additional inertia when the handle reaches a certain position. In a variant of the exercise device, this component of additional inertia is added when the speed is in a particular direction. In this way, a multitude of advantageous exercises for muscular development can be produced. This notably makes it possible to stress the muscles of the user more intensely when they are in a particular position.

In a variant of the device presented in FIG. 1, the motor shaft 2 is linked to a speed reducer that has a reduction ratio r. The presence of such a reducer makes it possible to generate relatively significant forces while reducing the size of the motor, in the interests of miniaturizing the device. The pulley 3 is fixed onto an output shaft of the reducer. In this variant, the presence of a reducer greatly increases the real inertia of the moving parts of the motor 1 imparted to the handle 6. The real inertia of the device is also increased by the inertia imparted from the rotating parts of the reducer. The inertia of the motor and of the reducer imparted to the output of the reducer $J_{tot}$ can be written:

$$J_{tot}=J_{red}+r^2J_{mot} \tag{7}$$

with the inertia of the reducer $J_{red}$ and the real inertia of the motor $J_{mot}$. Thus, if the reduction ratio r is high, the real inertia of the system is greatly increased. Thus, the use of a negative proportional factor k makes it possible in this variant to compensate all or part of the inertia induced by this reducer. This compensation is all the more accurate when the acceleration which is measured to generate the artificial inertia force is the acceleration of the motor shaft 2, such that this measurement takes into account the effect of the reducer, an effect which consists in increasing, by the ratio r, the acceleration on the motor shaft 2 relative to the acceleration exerted on the handle 6.

The very simple exercise device described with reference to FIGS. 1 and 2 is given by way of illustration, but the invention is in no way limited to this type of exercise device. Notably, the invention can be adapted to any type of exercise machine stressing any part of the body. As an example, the invention can be adapted to form a device of rowing machine, exercise bicycle or lifting bar type.

Figure 7:
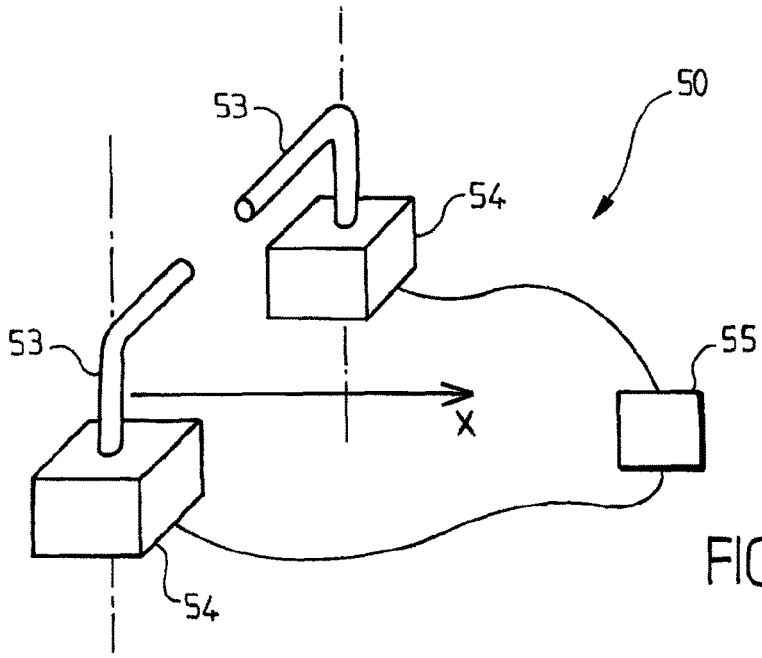
FIG. 7 is a schematic representation of a variant of the exercise device.

With reference to FIG. 7, an exercise device 50 is represented for exercising the muscles of the arms in pulling and pushing modes, in which control methods according to the invention can be implemented.

The device 50 comprises two levers 53 which can be displaced alternately forward and backward by a user. The levers 53 are each coupled to an electric motor 54 which is controlled by the control device 55. According to one embodiment, the motors 54 are controlled in such a way as to generate a force represented by the curve 33 of FIG. 4. For the purposes of simplification, the rotary movement of the levers is approximated as a linear movement along the axis x.

Figure 4:
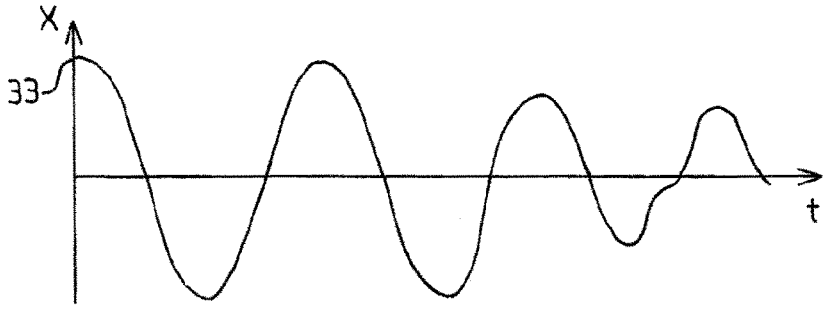
FIG. 4 is a graph of the force exerted by the motor upon a manipulation of the device of FIG. 7.

Thus, FIG. 4 represents the effort working against a user in the context of the exercise device represented in FIG. 7. The curve 33 represents the force generated by the motor and presents a value proportional to the acceleration curve 30. It is assumed that a user performs stressing actions on the lever 53 in such a way that the measured position and the acceleration are the same as in FIG. 3, the axis x here replacing the axis z. In this type of exercise, the control device 55 submits a control signal to the motors 54 which does not induce any load component. Only an artificial inertia component is produced by the motors 54. Thus, the effort undergone by the user is proportional to the acceleration and therefore corresponds to a simulated inertia without load which is greater than the real inertia of the device.

This type of stress with an artificial inertia with no additional load is also advantageous in an exercise machine stressing the leg muscles. In practice, the muscular stress produced by the motor when it is controlled in this way corresponds substantially to the muscular stress needed to reverse the movement of a runner on a horizontal terrain. Such an exercise is illustrated in FIG. 10.

Figure 10:
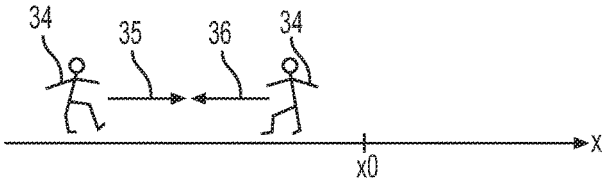
FIG. 10 is a schematic representation of an exercise for reversing the movement of a runner.

In FIG. 10, the runner 34 is initially running at high speed in the direction of the axis x, as schematically represented by the speed vector 35. At the end of the exercise, the runner 34 is running at high speed in the direction opposite to the axis x, as schematically represented by the speed vector 36. During the exercise, the runner 34 has therefore had to slow down his or her movement to a stop, occurring for example at the point x0, and then speed up again in the other direction. The muscles of the runner 34 have therefore been stressed during this exercise essentially to overcome the inertia of the runner him- or herself, oriented on the axis x. Since the force of gravity is perpendicular to the movement, it does not create any particular muscular stress in this exercise, that is to say that the muscular stress specific to the exercise is a pure inertia stress. The exercise machine programmed to produce this type of stress is all the more advantageous when this reversal of direction situation is very commonplace in ball sports, for example rugby or football.

Similarly, a control program associating the artificial inertia force with a constant load makes it possible to produce a muscular stress similar to accomplishing the same exercise on a sloping terrain.

A device that makes it possible to simulate an additional viscous friction force will now be described. The device is similar to the device described with FIG. 7 and comprises a microprocessor that has the same structure as the microprocessor 20 of the control system described in FIG. 2. The force exerted by the motor here comprises three components. The first two components correspond to the load component and to the inertia component described above. The third component is a viscous friction component. Thus:

$$F_m=F_{ch}F_i+F_{fv} \quad (8)$$

in which the force $F_{fv}$, corresponding to the viscous friction component, is defined as a function of a coefficient of proportionality $k_2$ and as a function of the speed v of the handle:

$$F_{fv}=k_2\times v \quad (9)$$

The speed v is determined by the computation module 12 using a speed signal which is transmitted to the computation module 12 via the connection 16.

Thus, when the user displaces the levers in one direction, the motor generates a torque on the lever comprising the component of viscous friction proportional to the speed of displacement of the lever in addition to an inertia component. This viscous friction component causes an additional stress which opposes the direction of movement of the user. In this way, the device simulates a viscous friction that can be produced by a machine comprising a fin system.

The coefficient $k_2$ can be a constant stored in the memory of the microprocessor 20. In the same way as the inertia component, the computation module 12 can control the coefficient of proportionality $k_2$ in multiple ways. By way of example, the computation module can vary the coefficient of proportionality $k_2$ as a function of the position of the handle.

Figure 8:
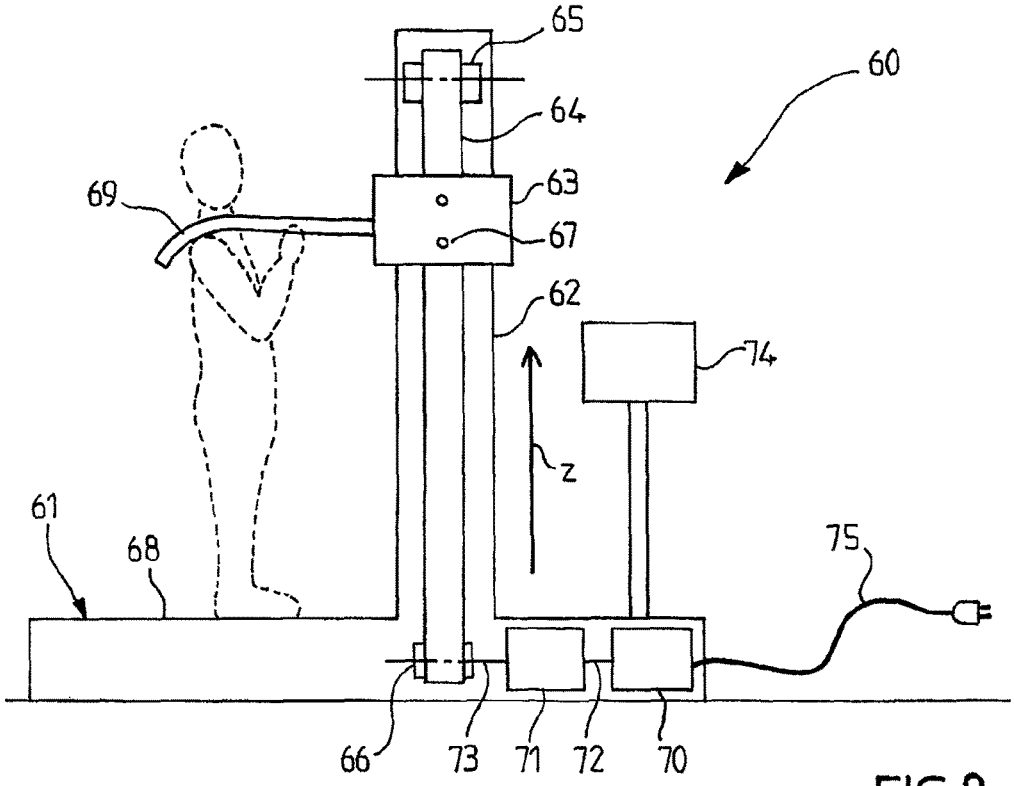
FIG. 8 is a schematic representation partially in cross section of an exercise device including a motor according to another embodiment.
Figure 9:
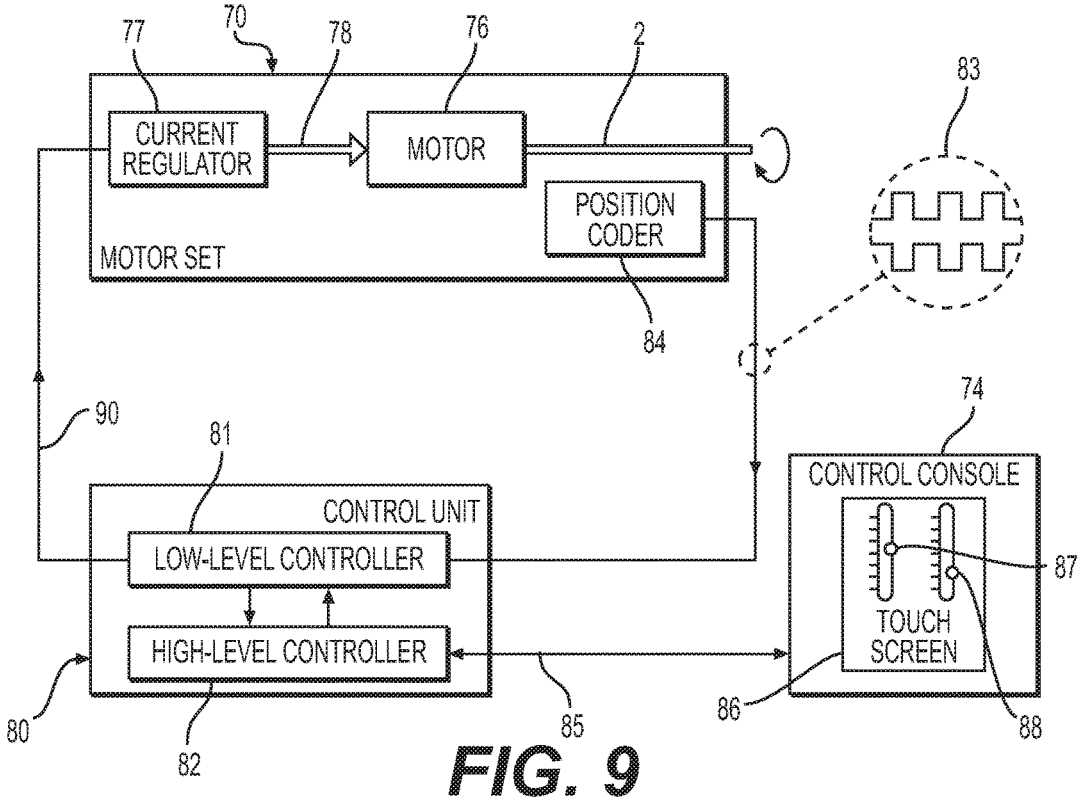
FIG. 9 is a functional schematic representation of a control system for the motor represented in FIG. 8.

Referring to FIGS. 8 and 9, there now follows a description of another exercise machine 60 using an electric motor. The machine 60 has a form relatively similar to a weight machine known as a squat machine. However, it can provide a much wider range of muscular stresses.

The structure of the machine comprises a metal plinth 61 placed on the ground, shown in cross section in FIG. 8, and a guiding column 62 fastened vertically to the plinth 61. The top surface of the plinth 61 constitutes a platform 68 intended to accommodate an athlete, for example in a standing position as illustrated by a broken line. A carriage 63 is mounted to slide on the column 62 by guiding means that are not represented, so as to be translated vertically along the column 62. According to one embodiment, the carriage 63 is a four-sided structure which completely surrounds the column 62, both having a square section. The carriage 63 bears gripping rods 69 which extend over the platform 68 and are intended to be engaged with the athlete, for example at the level of his or her shoulders, arms or legs depending on the desired exercise.

A transmission belt 64 is mounted in the column 62 and extends between an idler pulley 65 mounted to pivot at the top of the column 65 and a driving pulley 66 mounted to pivot in the plinth vertically in line with the column 62. The belt 64 is a toothed belt which performs a closed loop reciprocal travel between the pulleys 65 and 66 so as to be coupled without slip to the driving pulley 66. The carriage 63 is securely attached to one of the two branches of the belt 64, for example by means of rivets 67 or other fastening means, in such a way that it is also coupled without slip to the driving pulley 66, any rotation of the pulley 66 being translated into a vertical translation of the carriage 63. Preferably, the belt 64 is formed from a toothed band of AT10 type whose two ends are fixed to the carriage 63, in such a way as to close the loop at the carriage 63.

A motor set 70 is housed in the plinth 61 and coupled to the driving pulley 66 via a speed reducer 71. More specifically, the speed reducer 71 comprises an input shaft 72 coupled without slip to the motor shaft of the motor set, which is represented in more detail in FIG. 9, and an output shaft 73 which bears the driving pulley 66. The speed reducer 71 imposes a reduction ratio r between the speed of rotation w1 of the shaft 72 and the speed of rotation w2 of the shaft 73, namely w1/w2=r. According to embodiments, the reduction ratio r is chosen between 3 and 100, and preferably between 5 and 30.

The machine 60 also comprises a control console 74 which can be securely attached to the plinth 61 or independent thereof. Furthermore, an electrical power supply cable 75 exits from the plinth 61 to be connected to the electrical network. The machine 60 does not require an exceptional electrical power supply and can therefore be powered by an everyday domestic network.

FIG. 9 represents more specifically the motor set 70 and its control unit 80, which is also housed in the plinth 61. The motor set 70 comprises an electric motor 76, for example a self-driven synchronous motor, and a current regulator 77 which controls the power supply current 78 to the motor 76.

It will be recalled that the self-driven synchronous motor exhibits a constant rotor flux. This flux is created by permanent magnets or windings mounted in the rotor, while the variable stator flux is created by a three-phase winding making it possible to orient it in all directions. The electronic control of this motor consists in controlling the phase of the current waves so as to create a revolving field, always 90° in advance of the field of the magnets, in order for the torque to be maximal. In these conditions, the motor torque on the motor shaft 2 is proportional to the stator current. This current is accurately controlled in real time by the control unit 80 via the current regulator 77.

For this, the control unit 80 comprises a low-level controller 81, for example of FPGA type, which receives the position signal 83 from the position coder 84 of the motor shaft 2 and performs real-time computations from the position signal 83 to determine the instantaneous values of the position, the speed and the acceleration of the motor shaft 2. The position coder 84 is, for example, an optical device which supplies two square wave signals in quadrature according to the known technique.

The high-level controller 82 comprises a memory and a processor and executes complex control programs on the basis of the information supplied in real time by the low-level controller 81. Possible control programs have been described above with reference to FIGS. 3 to 6.

The control console 74 is linked to the high-level controller 82 by a TCP/IP link 85, wired or wireless, and comprises an interface enabling the athlete or his or her trainer to select prerecorded exercise programs or to set the parameters of such a program precisely and in a personalized manner. In the example represented, the interface is a touch screen 86 which comprises a cursor 87 for setting the value of the load $F_{ch}$ along a predetermined scale, for example 0 to 3000 N, and a cursor 88 for setting the value of the coefficient k along a predetermined scale, that is to say the artificial inertia force $F_i$.

Depending on the exercise program being executed, the high-level controller 82 processes the information supplied in real time by the low-level controller 81 and computes the instantaneous torque that has to be exerted by the motor set 70. The low-level controller 81 generates a control signal 90 corresponding to this instantaneous torque and transmits the signal 90 to the current regulator 77, for example in the form of an analog control voltage varying between 0 and 10 V. As a variant, a CAN digital interface may also be used.

The control programs that make it possible to simulate different exercises can be many. Preferably, regardless of the detail of the program, it is always the athlete who controls the machine 60 and the machine 60 which reacts to the stress exerted by the athlete on the gripping bars 69. For this, it is preferable for the machine 60 to be able to react rapidly to the changes of direction imposed by the athlete, despite the frictions which inevitably exist in such a mechanical system.

For this, according to one embodiment, the high-level controller 82 implements a friction compensation algorithm which will now be explained.

The mass of the carriage 63 is denoted mc. Fc=(mc.g) denotes the force that the motor 76 must impose on the belt 64 to compensate the weight of the carriage 63 without the user supporting any load. The algorithm uses parameters Fa and Fb defined by the fact that if the motor 76 applies (Fc+Fa) the carriage 63 is at the limit of the movement in the positive direction, upward, and if the motor 76 applies (Fc−Fb) the carriage 63 is at the limit of the movement in the negative direction, downward. These parameters Fa and Fb can be measured by trial and error. The algorithm governs the transition from the force (Fc+Fa) to the force (Fc−Fb) in the case of a change in the direction of the stress exerted by the user. The algorithm applies laws which use the linear speed v of the carriage 63 and a coefficient kf, namely:

$$Fch0=Fc+kf.v \tag{10}$$

$$(Fc-Fb)<Fch0<(Fc+Fa) \tag{11}$$

in which Fch0 designates the force imposed by default on the belt 64 by the motor 76, namely the value which is applied when the cursor 87 is placed on the zero graduation. In other words, if the cursor 37 is placed on the 3000 N graduation for an exercise program for exerting this load alternating in both directions, and the carriage 63 weighs 60 kg, the electric motor will in fact exert a force of approximately 3600 N in the upward direction and 2400 N in the downward direction.

Thus, the higher the coefficient kf, the quicker the machine reacts to the changes of direction imposed by the user. Beyond a certain limit, a very strong reactivity would entail a frequency-domain filtering of the speed measurement, for example of first order low-pass type.

According to the program selected, for example, when an artificial inertia force proportional to the acceleration and/or a viscous force proportional to the speed is applied by the motor, or when the program provides different reactions in the concentric direction and in the eccentric direction, the computed force to be applied may suffer a discontinuity at the time of the reversal of the direction, which is necessarily prejudicial to the comfort with which the machine is used.

According to one embodiment, the high-level controller 82 implements an algorithm that makes it possible to avoid these discontinuities. To do this, the controller 82 detects a change of direction by the passage of the speed signal through a hysteresis comparator schematically represented in FIG. 11.

On starting the concentric phase, if the speed $v > \varepsilon$, the controller 82 triggers the transition from F2 to F1. This variation is made at a constant rate of variation per unit of time, for example of the order of 200 N/s.

Similarly, upon the transition from the concentric phase to the eccentric phase, when the speed becomes negative and passes below a threshold $v < -\varepsilon$, the controller 82 triggers the transition from F1 to F2. The threshold value ε is chosen in such a way as to ensure a sufficient stability, namely that the motor does not switch from F1 to F2 in an untimely manner when the athlete decides to make a stop in his or her movement.

Figure 11:
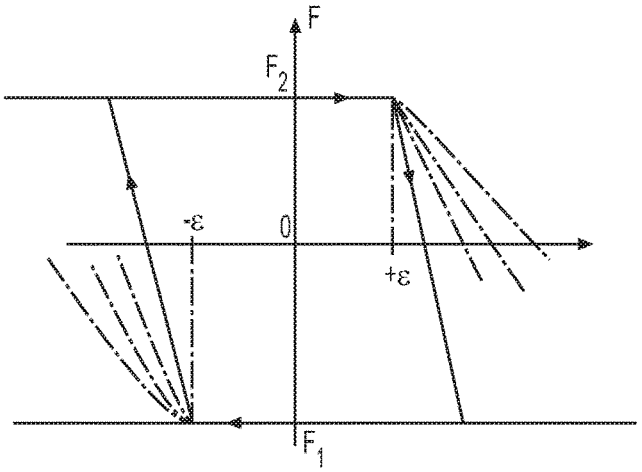
FIG. 11 is a graphic representation of the operation of a hysteresis comparator that can be used in the control system of FIG. 9.

In FIG. 11, it is noted that the curves of variation of the force as a function of the speed between the values F1 and F2 are not imposed by the system and in fact depend on the behavior of the user, namely how he or she varies the speed as a function of time, since the system imposes a force variation rate as a function of time.

In addition, the control program may prohibit the motor from performing more than two consecutive changes if the difference in position of the moving part between the two changes does not exceed a certain limit, for example 10 cm.

In other embodiments, the exercise program may also comprise a contribution of elastic force $F_e$ defined as a function of a coefficient of proportionality $k_3$ and as a function of the position z of the carriage 63:

$$F_e=k_3\times(z-z0) \tag{12}$$

in which z0 is a parameterizable reference height and the position z is determined by the low-level controller 81.

It will therefore be understood that numerous exercise programs can be designed by combining, by choice, additive contributions chosen from the group comprising a contribution of artificial inertia proportional to the measured acceleration, a contribution of viscous friction proportional to the measured speed, an elastic contribution proportional to the measured position and a predetermined load contribution. According to one embodiment, the human-machine interface enables the user to independently set the parameters of each of these contributions, notably the coefficients k, $k_2$ and $k_3$.

When the exercise program is asymmetrical, namely it provides different reactions in the concentric direction and in the eccentric direction, for example a first load value $F_{ch}=F_A$ in the upward direction and a second load value $F_{ch}=F_D<F_A$ in the downward direction of the carriage, the force applied by the actuator may undergo a discontinuity at the moment of the reversal of the direction. The use of a force ramp exhibiting a rate of variation per unit of time that is constant to eliminate this discontinuity at the moment of the reversal of the direction however presents a drawback in the case of an exercise performed at high speed. In effect, this force ramp is spread out over a fixed duration by the deviation between the load values $F_D$ and $F_A$ At a high speed, the user can perform a significant part of the travel of the carriage during the transitional time interval, such that the loads theoretically planned for the exercise are applied only over a small portion of the exercise and an objective of the exercise program in athletic and physiological terms is not actually achieved.

Figure 12:
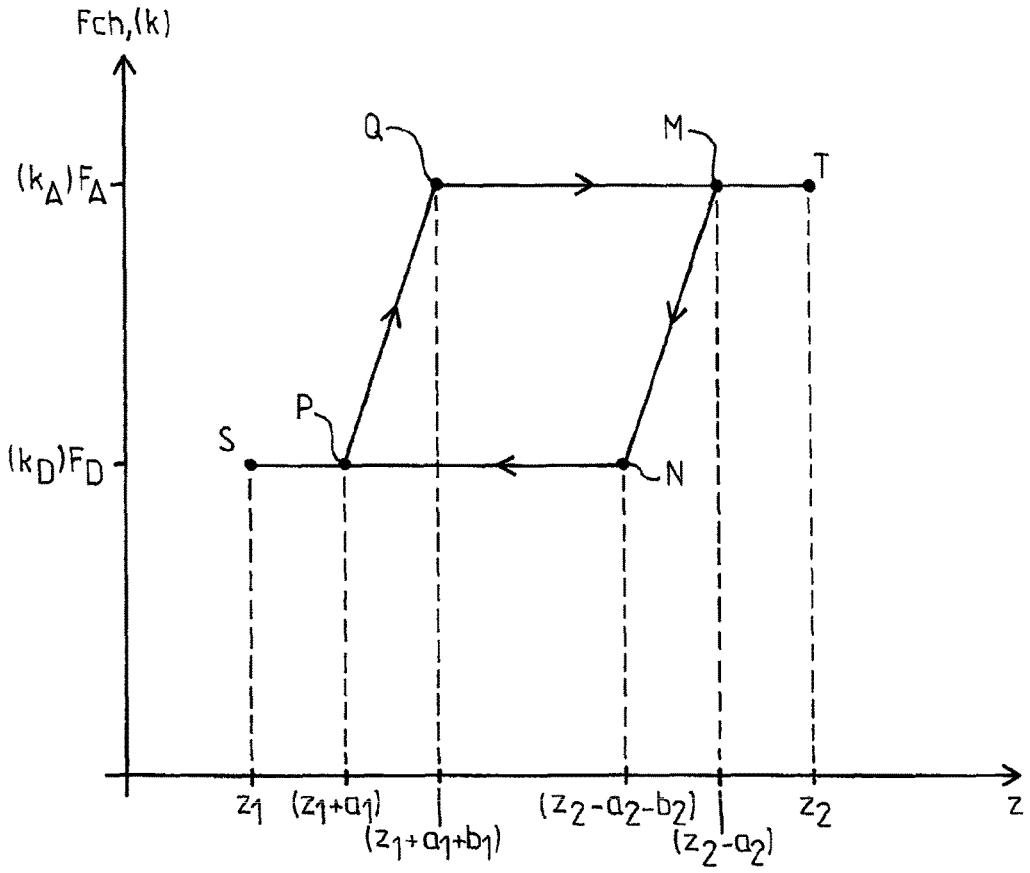
FIG. 12 is a graphic representation of a load computation method that can be executed by the control system of FIG. 9.

Referring to FIG. 12, there now follows a description of another method for computing the load component at the moment of the reversal of the direction in an asymmetrical exercise program. In FIG. 12, the x axis represents the position of the carriage 63 along an axis z oriented upward and the y axis represents the load component applied by the electric actuator during an exercise.

The principle of this method is explained with reference to a cyclical up-down movement performed by a user and schematically represented in FIG. 12. The movement comprises an up phase symbolized by the arrows directed in the positive direction of the axis z and a down phase symbolized by the arrows directed in the negative direction of the axis z. The points M (x axis $z_2-a_2$) and P (x axis $z_1+a_1$) are the points where the two changes of direction of the movement performed by the user are respectively detected. The exercise program provides a load component $F_{ch}=F_A$ in the upward direction and a load component $F_{ch}=F_D<F_A$ in the downward direction of the carriage. This load component is possibly combined with other additive components not represented, as described previously.

In the case of the up to down reversal, from the current position of the carriage at the moment when the reversal of direction is detected (point M, x axis $z_2$-$a_2$), an end-of-transition position is computed at a distance $b_2$, namely the point N (x axis $z_2$-$a_2$-$b_2$). Then, the load component is computed as a decreasing monotonic function, for example linear, of the position of the carriage between the points M and N to pass from $F_A$ to $F_D$.

In the case of the down to up reversal, from the current position of the carriage at the moment when the reversal of direction is detected (point P, x axis $z_1+a_1$), an end-of-transition position is computed at a distance $b_1$, namely the point Q (x axis $z_1+a_1+b_1$). Then, the load component is computed as an increasing monotonic function, for example linear, of the position of the carriage between the points P and Q to pass from $F_A$ to $F_D$.

The distances $b_1$ and $b_2$ are for example constant parameters, possibly equal, stored in the memory of the control unit 80. Preferably, the distances $b_1$ and $b_2$ lie between 20 and 100 mm. In FIG. 12, the distances $b_1$ and $b_2$ have been exaggerated for legibility, but in practice, the distances $b_1$ and $b_2$ can represent a very small proportion of the travel of the carriage.

The above method can be employed with different methods for detecting the reversal of the movement such as a method based on the detection of a reversal of sign of the detected speed or any other suitable method. There now follows a description of a particular detection method which is also illustrated in FIG. 12.

In the movement schematically represented in FIG. 12, the extreme points actually reached by the carriage 63 are, at the top, the point T (x axis $z_2$) and, at the bottom, the point S (x axis $z_1$). The detection of the reversal of the up-to-down movement is here based on a position hysteresis threshold $a_2$: the method consists in detecting the extreme position T and in detecting the distance travelled in the reverse direction from the extreme position. When this distance reaches the position hysteresis threshold $a_2$ (point M, x axis $z_2-a_2$), the reversal detection occurrs. Similarly, the detection of the reversal of the down-to-up movement is based on a position hysteresis threshold $a_1$: the method consists in detecting the extreme position S and in detecting the distance travelled in the reverse direction from the extreme position. When this distance reaches the position hysteresis threshold $a_1$ (point P, x axis $z_1+a_1$), the reversal detection occurs.

The thresholds $a_l$ and $a_2$ are for example constant parameters, possibly equal, stored in the memory of the control unit 80. Preferably, the thresholds $a_1$ and $a_2$ lie between 5 and 20 mm. In FIG. 12, the distances $a_1$ and $a_2$ have been exaggerated for legibility, but in practice, the distances $a_1$ and $a_2$ can represent a very small proportion of the travel of the carriage.

In the methods described above, it will be appreciated that the x axes $z_1$ and $z_2$ are set by the user and not by the control unit. There is no obligation for the movement of the user to be perfectly repetitive. The points S and T can therefore be different in each cycle and the other points are each time computed as a consequence of the actual movement performed by the user.

The methods described with reference to FIG. 12 to perform a transition between two values of the load component $F_{ch}$ are applicable similarly to other parameters of an asymmetrical exercise program. In a second exemplary asymmetrical exercise, the coefficient k used to generate the artificial inertial component takes different values in the concentric direction and in the eccentric direction, for example a first value $k=k_A$ in the upward direction and a second value $k=k_D<k_A$ in the downward direction of the carriage. In this exercise, the force applied by the actuator can also undergo a discontinuity because the instantaneous acceleration is typically high at the moment of the reversal of the direction. Similarly, there may therefore be provided a method for computing the coefficient k which performs a gentler transition at the moment of the reversal of direction. The principle of this method will be understood immediately according to the indications between parentheses of the parameters (k), ($k_D$) and ($k_A$) in FIG. 12.

Such a change of value of the coefficient k used to generate the artificial inertial component can also be implemented at the moment when the acceleration changes sign by being cancelled, in which case no progressive transition is necessary since the artificial inertial component is substantially zero at the instant of the change of value.

In a variant embodiment, the coefficient k used to generate the artificial inertial component varies as a function of one or more parameters of the movement, for example according to an increasing linear function of the measured acceleration.

For illustration purposes, reference has been made to the carriage 63 of FIG. 8 in the above description, but any exercise machine regardless of the form of its moving load element can exploit the computation methods indicated above.

Figure 13:
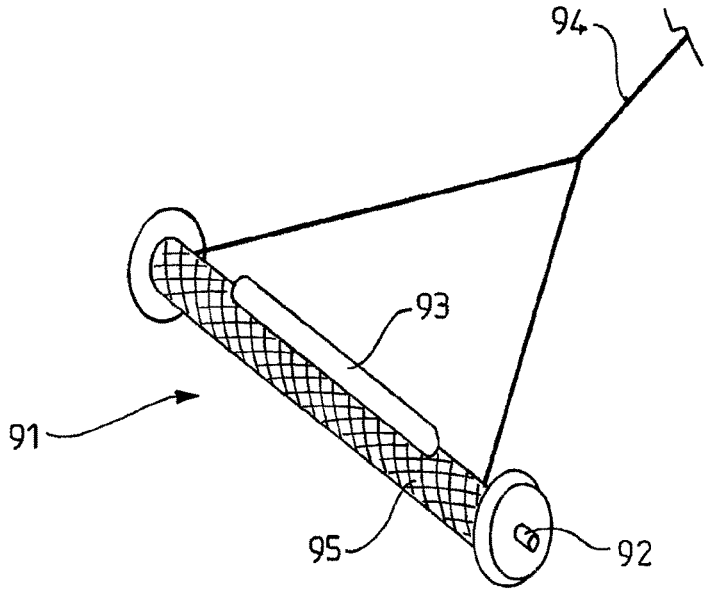
FIG. 13 is a schematic representation in perspective of a handle that can be used in exercise devices.

With reference to FIG. 13, a load element is represented in the form of a handle 91 provided with control buttons 92 and 93 that can be used to control, trigger or disable various functions of the exercise machine in the manner of a remote control. In the example represented, the handle 91 intended to be held in one or two hands is attached to the end of a line 94 that can be used for example in the machine of FIG. 1. In addition to being used to exert the pulling force on the line 94, the handle 91 therefore makes it possible to control the machine during the exercise. For that, the button 92 situated at the end of the bar can be actuated by a thumb pressure, while the elongate button 93 can be actuated by pressure from the fingers of the hand by gripping the bar 95. These positions of the buttons 92 and 93 are purely illustrative.

The functions of the buttons 92 and 93 can vary. In one example, the button 93 fulfills a "dead-man" function, namely that the electrical power supply of the motor is deactivated as soon as the button 93 is released, which fulfills a safety objective. In one example, the button 92 fulfills a function for triggering the change of load value, namely the transition between two load values $F_A$ and $F_D$ occurs only if the button 92 is pressed at the moment when the reversal of the movement is detected. Otherwise, the exercise continues with a constant load value before and after the reversal of the movement.

In another example, the actuation by the user of the button 92 or 93 immediately triggers a progressive transition of the load component from a first programmed value FA to a second programmed value FB, greater or smaller, independently of the phase of the movement during which this actuation is performed.

Other types of control elements can be arranged similarly on the handle 91 or on the gripping bar 69, for example buttons, levers, potentiometers or similar to facilitate the control of the machine by the user during the exercise.

Although the embodiments described above comprise rotary motors, the control methods described above may be employed with any other type of electric actuator. In particular, a linear motor may be used to generate a force on the manipulation element.

Moreover, the computation of the control signal may be performed in different ways, in a unitary or distributed manner, by means of hardware and/or software components. Hardware components that can be used are custom integrated circuits ASIC, programmable logic arrays FPGA or microprocessors. Software components can be written in different programming languages, for example C, C++, Java or VHDL. This list is not exhaustive.

Although the invention has been described in conjunction with a number of particular embodiments, it is obvious that it is in no way limited thereto and that it includes all the technical equivalents of the means described and their combinations provided the latter fall within the framework of the invention.

The use of the verb "comprise" or "include" and its conjugated forms does not preclude the presence of elements or steps other than those stated in a claim. The use of the indefinite article "a" or "an" for an element or a step does not preclude, unless otherwise stipulated, the presence of a plurality of such elements or steps. A number of means or modules may be represented by one and the same hardware element.

In the claims, any reference symbol between brackets would not be interpreted as a limitation on the claim.

The invention claimed is:

1. A control method for controlling an electric actuator in an exercise device comprising a load element intended to be displaced by the force of a user and coupled without slip to a moving part of the electric actuator, a control unit and a position coder arranged so as to detect an instantaneous position of the moving part and to generate a position signal representative of the instantaneous position of the moving part, the control method comprising the execution by the control unit of:

receiving the position signal generated by the position coder;

detecting a direction of the displacement of the load element from the position signal generated by the position coder;

supplying a first load set point ($F_A$, $k_A$) upon a displacement of the load element in an upward direction wherein the electric actuator simulates a mass to be raised, the first load set point being a control signal generated by the control unit;

supplying a second load set point ($F_B$, $k_B$) upon a displacement of the load element in a downward direction, wherein the electric actuator simulates a mass to be lowered, the downward direction being opposite to the upward direction, the second load set point being a control signal generated by the control unit; and in response to the detection of a reversal of the displacement of the load element between the upward direction and the downward direction, supplying a transition load set point varying progressively from the first load set point to the second load set point during a time interval;

detecting an initial position (M) of the moving part of the electric actuator or of the load element at the moment when the reversal of the movement is detected from the position signals generated by the position coder;

computing an end-of-transition position (N) exhibiting a deviation in the downward direction relative to the initial position, the deviation between the end-of-transition position (N) and the initial position (M) being a predetermined constant $b_2$ stored in a memory of the control unit;

supplying the transition load set point in the form of a control signal generated by the control unit, said control signal being representative of a monotonic function of the position of the moving part of the electric actuator or of the load element, said monotonic function varying from the first load set point ($F_A$, $k_A$) to the second load set point ($F_B$, $k_B$) between the initial position (M) and the end-of-transition position (N);

wherein the reversal of the displacement of the load element between the upward direction and the downward direction is detected with the steps of:

detecting a signal of position, speed, acceleration or time of the displacement of the load element; and triggering a transition of direction when the signal crosses a determined threshold value.

2. The method as claimed in claim 1, in which the transition load set point varies with a rate of variation per unit of displacement that is constant from the first load set point to the second load set point, the monotonic function being an affine function.

3. The method as claimed in claim 1, in which the deviation between the end-of-transition position of the load element and the initial position of the load element lies between 2 and 200 mm.

4. The method as claimed in claim 1, in which the deviation between the end-of-transition position of the load element and the initial position of the load element lies between 20 and 100 mm.

5. The method as claimed in claim 1, further comprising:

detecting an instantaneous speed of the load element or of the moving part of the electric actuator; and detecting the reversal of the displacement of the load element between the upward direction and the downward direction in response to a change of sign of the detected speed.

6. The method as claimed in claim 1, further comprising:

detecting the instantaneous position of the load element or of the moving part of the electric actuator over time;

detecting an extreme position (T) of the load element or of the moving part of the electric actuator in the upward direction;

determining a deviation in the downward direction between the detected instantaneous position and the extreme position; and detecting the reversal of the displacement of the load element between the upward direction and the downward direction when the deviation in the downward direction crosses a determined reversal threshold a2.

7. The method as claimed in claim 6, in which the reversal threshold $a_2$ is a predetermined constant.

8. The method as claimed in claim 6, in which the reversal threshold lies between 2 and 200 mm, preferably between 5 and 20 mm.

9. The method as claimed in claim 1, further comprising:

in response to the detection of a second reversal of the displacement of the load element between the downward direction and the upward direction, supplying a second transition load set point varying progressively from the second load set point to the first load set point during a second time interval;

detecting a second initial position (P) of the moving part of the electric actuator or of the load element at the moment when the second reversal of the movement is detected;

computing a second end-of-transition position (Q) exhibiting a deviation in the upward direction relative to the second initial position;

supplying the second transition load set point in the form of a monotonic function of the position of the moving part of the electric actuator or of the load element, said monotonic function varying from the second load set point to the first load set point between the second initial position (P) and the second end-of-transition position (Q).

10. The method as claimed in claim 1, further comprising:

computing a force to be exerted by the electric actuator at successive instants during displacements of the load element as a function of the load set point supplied at each of said successive instants; and generating a control signal to control the electric actuator with the control signal such that the force exerted by the electric actuator in response to the control signal corresponds to the computed force to be exerted.

11. The method as claimed in claim 10, in which the force to be exerted is computed as a sum of the load set point $F_{ch}$ supplied at each of said successive instants with at least one additive contribution selected from a contribution of inertial force proportional to a measured instantaneous acceleration of the moving part of the electric actuator or of the load element, a contribution of elastic force proportional to the deviation between a reference position and a measured instantaneous position of the moving part of the electric actuator or of the load element, and a contribution of viscous force proportional to a measured instantaneous speed of the moving part of the electric actuator or of the load element, the contribution of viscous force being equal to the product of said instantaneous speed by a predetermined viscosity coefficient stored in a memory.

12. An exercise device comprising:

a load element intended to be displaced by the force of a user;

an electric actuator comprising a moving part, the load element being coupled without slip to the moving part;

a position coder arranged so as to detect an instantaneous position of the moving part and to generate a position signal representative of the instantaneous position of the moving part;

a computer configured to compute a force to be exerted by the electric actuator at successive instants during displacement of the load element as a function of a load set point supplied at each of said successive instants and to generate a control signal of the electric actuator as a function of the computed force to be exerted, in which the computer, is configured to:

receive a position signal generated by the position coder and detect a direction of the displacement of the load element from the position signal generated by the position coder;

supply a first load set point upon a displacement of the load element in an upward direction wherein the electric actuator simulates a mass to be raised, the first load set point being a control signal generated by the computer;

supply a second load set point upon a displacement of the load element in a downward direction wherein the electric actuator simulates a mass to be lowered, the downward direction being opposite to the upward direction, the second load set point being a control signal generated by the computer; and in response to the detection by the computer of a reversal of the displacement of the load element between the upward direction and the downward direction, supply a transition load set point varying progressively from the first load set point to the second load set point during a time interval;

detect an initial position of the moving part of the electric actuator or of the load element at the moment when the reversal of the movement is detected from the position signal generated by the position coder;

compute, in the computer, an end-of-transition position exhibiting a deviation in the downward direction relative to the initial position, the deviation between the end-of-transition position (N) and the initial position (M) being a predetermined constant b2 stored in a memory of the control unit; and supply the transition load set point in the form of a control signal generated by the computer, said control signal being representative of a monotonic function of the position of the moving part of the electric actuator or of the load element, said monotonic function varying from the first load set point to the second load set point between the initial position and the end-of-transition position;

wherein the reversal of the displacement of the load element between the upward direction and the downward direction is detected with the steps of:

detecting a signal of position, speed, acceleration or time of the displacement of the load element; and triggering a transition of direction when the signal crosses a determined threshold value.

13. The device as claimed in claim 12, in which the load element comprises a handle intended to be held in the hand by the user to exert the force of the user, the handle bearing a control member that can be actuated by the user to control a function of a computer.

* * * * *